US007854782B2

(12) United States Patent
Oh et al.

(10) Patent No.: US 7,854,782 B2
(45) Date of Patent: Dec. 21, 2010

(54) VACUUM CLEANER

(75) Inventors: Jang-Keun Oh, Gwangju (KR); Seung-Yong Cha, Gwangju (KR); Min-Ha Kim, Gwangju (KR); Hyoun-Soo Kim, Busan (KR); Hyun-Ju Lee, Gwangju (KR)

(73) Assignee: Samsung Gwangju Electronics Co., Ltd., Gwangju-City (KR)

( * ) Notice: Subject to any disclaimer, the term of this patent is extended or adjusted under 35 U.S.C. 154(b) by 460 days.

(21) Appl. No.: 11/975,434

(22) Filed: Oct. 19, 2007

(65) Prior Publication Data

US 2008/0264016 A1 Oct. 30, 2008

Related U.S. Application Data

(60) Provisional application No. 60/926,832, filed on Apr. 30, 2007.

(30) Foreign Application Priority Data

Jun. 18, 2007 (KR) ..... 10-2007-0059500

(51) Int. Cl.
*B01D 53/00* (2006.01)

(52) U.S. Cl. ..... 55/429; 55/428; 55/433; 55/337; 55/430; 55/466; 55/DIG. 3; 15/353

(58) Field of Classification Search ..... 55/428, 55/429, 337, 430, 432, 433, 466, DIG. 3; 15/353
See application file for complete search history.

(56) References Cited

U.S. PATENT DOCUMENTS 2,283,836 A * 5/1942 White ..... 55/429
2,714,426 A * 8/1955 White ..... 55/305
6,782,584 B2 * 8/2004 Choi ..... 15/352
7,749,295 B2 * 7/2010 Hwang et al. ..... 55/428
7,785,396 B2 * 8/2010 Hwang et al. ..... 95/1
2004/0261216 A1 * 12/2004 Choi et al. ..... 15/352
2005/0138763 A1 * 6/2005 Tanner et al. ..... 15/353
2007/0143953 A1 * 6/2007 Hwang et al. ..... 15/353
2008/0047094 A1 * 2/2008 Ha et al. ..... 15/347
2008/0172824 A1 * 7/2008 Yun et al. ..... 15/352
2008/0263816 A1 * 10/2008 Oh et al. ..... 15/347
2008/0264007 A1 * 10/2008 Oh et al. ..... 55/304
2008/0264014 A1 * 10/2008 Oh et al. ..... 55/423
2008/0264015 A1 * 10/2008 Oh et al. ..... 55/429

FOREIGN PATENT DOCUMENTS

JP 54-081668 6/1979
JP 54-085560 7/1979
JP 2003190056 A * 7/2003

* cited by examiner

*Primary Examiner*—Jason M Greene
*Assistant Examiner*—Dung Bui
(74) *Attorney, Agent, or Firm*—Ohlandt, Greeley, Ruggiero & Perle, LLP

(57) ABSTRACT

A vacuum cleaner includes a vacuum cleaner body, a cyclone unit which is mounted at the vacuum cleaner body, and separates dust from drawn air, a dust separating unit which is engaged with a lower end of the cyclone unit, said dust separating unit being configured to collect separated dust, said dust separating unit being detachable from the cyclone, and said dust separating unit comprising a compressing plate compressing the collected dust; and a driving unit which is disposed at a lower end of the dust separating unit, said driving unit being configured to ascend and descend the dust separating unit to be detachably connected to the cyclone unit and drives the compressing plate.

8 Claims, 6 Drawing Sheets

VACUUM CLEANER

CROSS-REFERENCE TO RELATED APPLICATIONS

This application claims priority under 35 U.S.C. §119 from Korean Patent Application No. 10-2007-0059500, filed on Jun. 18, 2007, with the Korean Intellectual Property Office, and U.S. provisional Application No. 60/926,832, filed Apr. 30, 2007, with the United States Patent and Trademark Office, the entire disclosure of which is hereby incorporated by reference.

BACKGROUND OF THE INVENTION

1. Field of the Invention

The present disclosure relates to a vacuum cleaner, and more particularly, to a vacuum cleaner capable of not only compressing dust in a dust separating unit, but also detachably mounting the dust separating unit to a cyclone unit by rotating manipulation of a lever.

2. Description of the Related Art

A vacuum cleaner draws in air and dust from a surface to be cleaned using the suction force.

Dust is separated from the drawn air and is collected in a space, in the interior of the vacuum cleaner. Various methods are applied to separate the dust from the drawn air. A cyclone method is one example. The cyclone method refers to a method wherein drawn air rotates in a space such that dust is separated from the drawn air by the centrifugal force.

A cyclone unit which draws in air and rotates the drawn air, and a dust separating unit which collects dust separated from the cyclone unit are required to apply the cyclone method. The cyclone unit and the dust separating unit may be formed as one body, but they may be implemented detachably. When the cyclone unit and the dust separating unit are implemented detachably, the dust separating unit is detached from the cyclone unit such that it becomes convenient to dump dust collected in the dust separating unit.

If the dust collected in the dust separating unit is compressed in the dust separating unit, a frequency that a user has to dump the dust by detaching the dust separating unit from the cyclone unit is reduced. A method for compressing dust is disclosed in Japan Patent Laid Open No. S54-85560. According to the disclosure, a fixing wall and a rotating wall are formed in a dust separating unit, and dust in the dust separating unit may be compressed by rotating along the rotating wall.

If a dust separating unit is detachably connected to a cyclone unit, and dust is compressed in the dust separating unit, user convenience is improved, particularly in a cyclone type vacuum cleaner.

However, a conventional dust separating unit has the structure for dust compression irrespective of the structure for detachment and attachment, such that a vacuum cleaner having the dust separating unit has a complex structure, and fabricating cost of the vacuum cleaner is increased. Additionally, it is difficult for a user to operate the vacuum cleaner.

SUMMARY OF THE INVENTION

The present disclosure has been made to overcome the above-mentioned problems of the related art. The present disclosure provides a vacuum cleaner in which dust in a dust separating unit is compressed, and also the dust separating unit is detachably connected to a cyclone unit by only one operation.

According to an aspect of the present disclosure, there is provided a vacuum cleaner comprising a vacuum cleaner body; a cyclone unit which is mounted at the vacuum cleaner body, and separates dust from drawn air; a dust separating unit which is engaged with a lower end of the cyclone unit, collects the separated dust, is separated from the cyclone unit as occasion demands, and comprises a compressing plate compressing the collected dust; and a driving unit which is disposed at a lower end of the dust separating unit, ascends and descends the dust separating unit to be detachably connected to the cyclone unit, and also drives the compressing plate.

The dust separating unit may further comprise a dust separating casing which is detachably connected at a lower end of the cyclone unit, and comprises a dust separating space of a cylinder shape therein; and an axis member which is straightly disposed according to the center axis of the dust separating space, and wherein the compressing plate is engaged with the axis member, and rotates integrally with the axis member.

The driving unit may comprise a lever portion which is disposed at a lower end of the dust separating casing to be rotatably operated, and ascends and descends the dust separating unit which is received on a separating unit receiving surface of the vacuum cleaner body according to the rotation of the driving unit; and a rotating force transfer portion which transfers a part of the rotating force of the lever portion to the axis member when the lever portion is rotated.

At least one elevating protrusion may be formed on the separating unit receiving surface, the elevating protrusion having a slope surface, and wherein the lever portion comprises a lever body of a circular shape in which at least one elevating groove corresponding to the shape of the elevating protrusion is formed in a side of the lever body, and which is connected with the rotating force transfer portion; and a lever which is protruded from the side of the lever body, and is rotatably operated, and wherein if the lever body is rotated by an operation of the lever, the elevating protrusion is inserted in the elevating groove according to the circumferential direction of the lever body, the lever body is ascended and descended, and also the rotating force transfer portion connected to the lever body is driven.

The rotating force transfer portion may comprise a main gear which is engaged with the upper surface of the lever body, and rotates integrally with the lever body; and a sub gear which is rotated in mesh with the main gear, and which has a center engaged with a lower end of the axis member.

The main gear may have more teeth than the sub gear for rotating the compressing plate to exceed an angle at which the lever is rotated.

The dust separating unit may further comprise a fixing wall which is fixedly mounted to occupy a space between the axis member and the interior wall of the dust separating casing; and an upper cover which covers an upper portion of the dust separating space, and comprises a dust slot through which the dust separated by the dust separating unit flows into the dust separating casing.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Certain exemplary embodiments of the present disclosure will now be described in greater detail with reference to the accompanying drawings.

Figure 1:
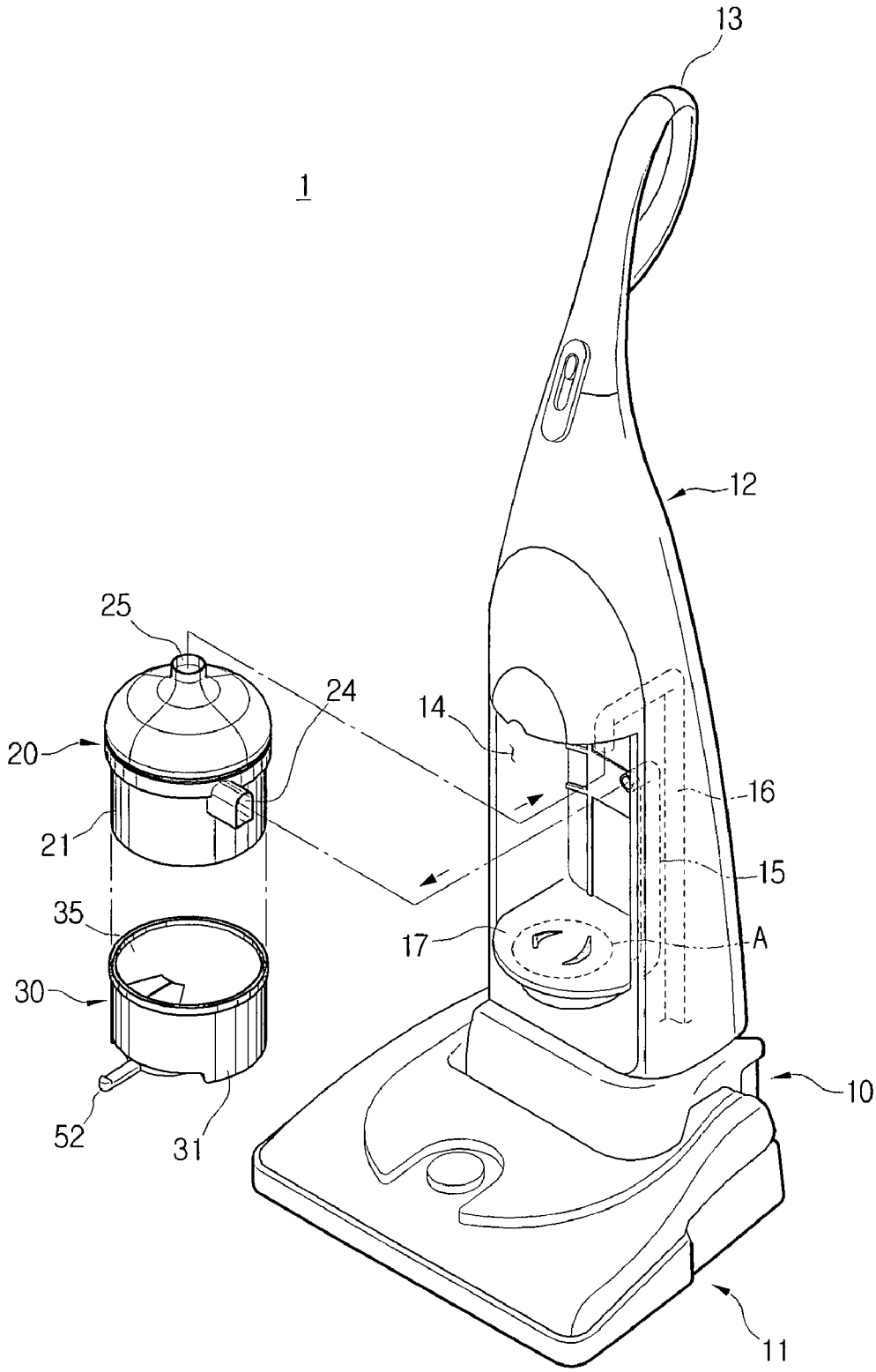
FIG. 1 is a fragmentarily exploded perspective view illustrating a vacuum cleaner according to an exemplary embodiment of the present disclosure.
Figure 2:
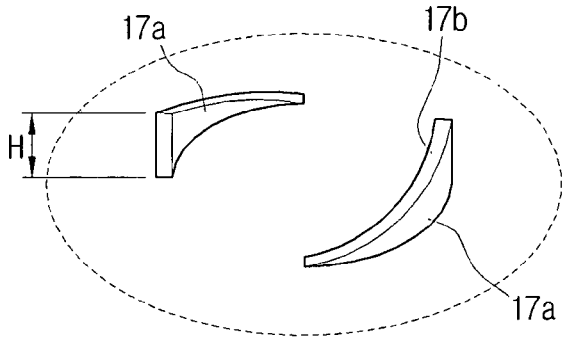
FIG. 2 is an enlarged perspective view illustrating a part A of FIG. 1.
Figure 3:
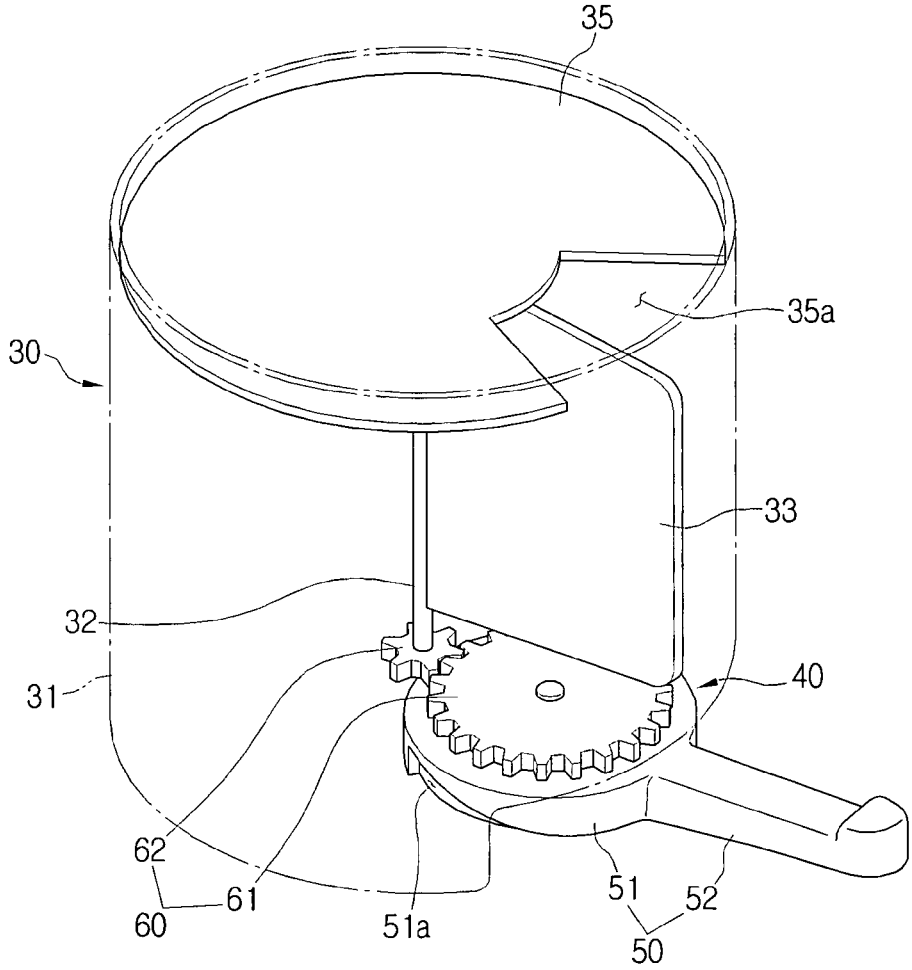
FIG. 3 is a perspective view illustrating a dust separating unit and a driving unit mounted in the vacuum cleaner of FIG. 1.
Figure 4:
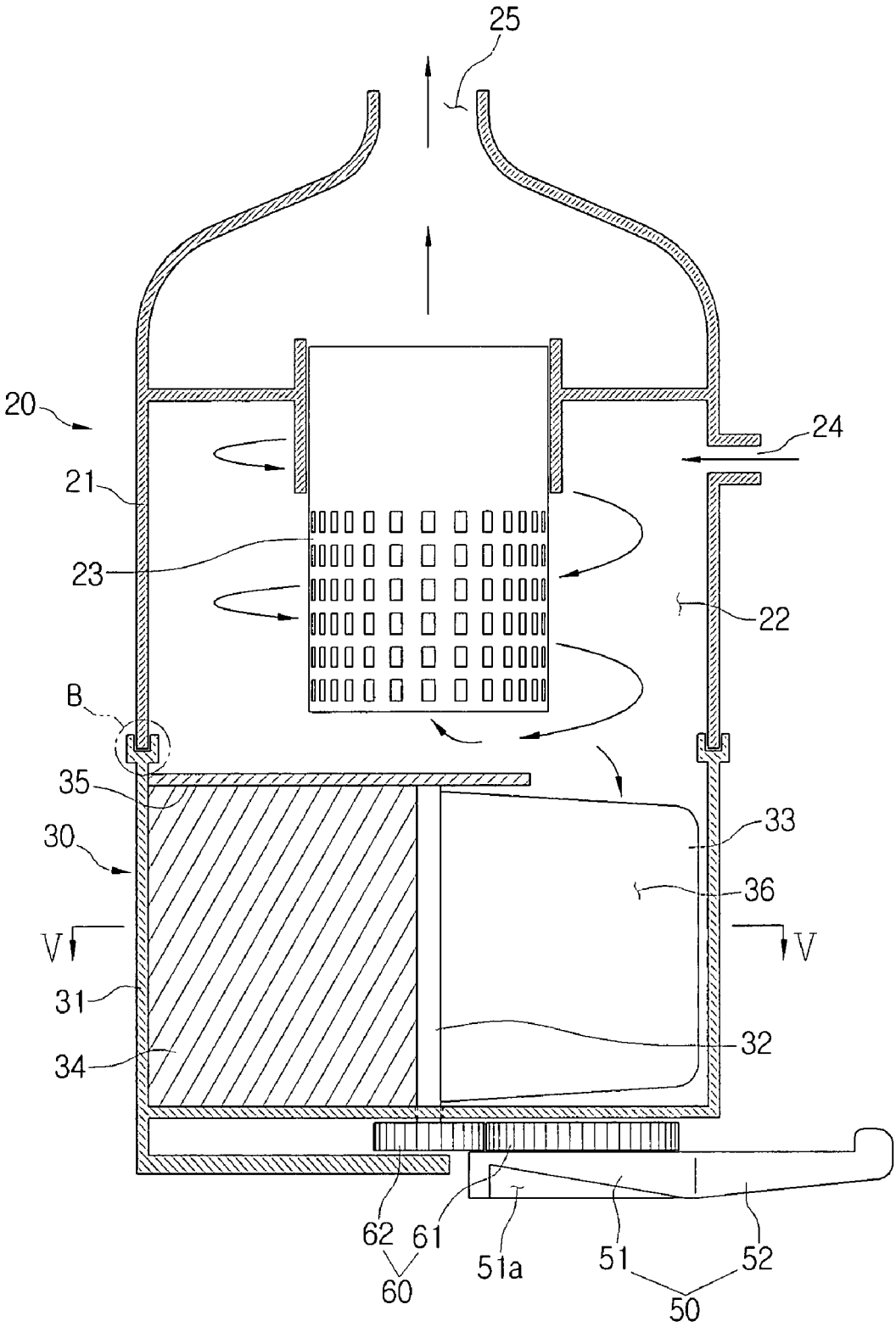
FIG. 4 is a sectional view illustrating a cyclone unit mounted on the vacuum cleaner of FIG. 1 and a dust separating unit provided therein.

FIG. 1 is a fragmentarily exploded perspective view illustrating a vacuum cleaner according to an exemplary embodiment of the present disclosure, FIG. 2 is an enlarged perspective view illustrating a part A of FIG. 1, FIG. 3 is a perspective view illustrating a dust separating unit and a driving unit mounted in the vacuum cleaner of FIG. 1, FIG. 4 is a sectional view illustrating a cyclone unit mounted on the vacuum cleaner of FIG. 1 and a dust separating unit provided therein.

Referring to FIGS. 1 to 4, a vacuum cleaner 1 according to an exemplary embodiment of the present disclosure may comprise a vacuum cleaner body 10, a cyclone unit 20, a dust separating unit 30, and a driving unit 40.

The vacuum cleaner body 10 may comprise a horizontal body 11 at the bottom, and a vertical body 12 which is engaged substantially perpendicularly to the horizontal body 11.

The horizontal body 11 comprises a suction motor (not shown) to generate suction force in the interior. A suction opening (not shown) is formed at a lower end of the horizontal body 11 to face a surface to be cleaned and to draw in air containing dust from the surface to be cleaned.

The vertical body 12 comprises a handle 13 for a user to operate the vacuum cleaner with ease, and a mounting space 14 formed therebelow to accommodate the cyclone unit 20 and the dust separating unit 30 therein. A separating unit receiving surface 17 to receive a lower portion of the dust separating unit 30 is formed on the bottom of the mounting space 14.

Referring to FIG. 2, two elevating protrusions 17*a* are formed on the separating unit receiving surface 17. The two elevating protrusions 17*a* are disposed on the circumference of the same circle, and are formed as the same configuration. An upper surface 17*b* of the two elevating protrusions 17*a* is formed as a slope surface. The two elevating protrusions 17*a* are involved in ascending and descending of the dust separating unit 30, which will be explained below.

The cyclone unit 20 is fixedly disposed at the upper portion of the mounting space 14 formed in the vertical body 12, and separates dust from drawn air. Referring to FIG. 4, a separating space 22 of a cylinder shape is formed in the interior of the cyclone unit 20, and a grill member 23 is formed at a center part in the separating space 22. The grill member 23 filters remaining dust, when the air is discharged to the cyclone unit 20 after being cleaned by centrifugal force.

An inlet 24 is formed at a side of the cyclone unit 20 to allow drawn air to flow into the separating space 22. The inlet 24 is connected with a suction opening which is formed at the lower portion of the horizontal body 11 through an air flowing pipe 15. An exhaust port 25, through which filtered air is discharged from the separating space 22, is formed at an upper end of the cyclone unit 20. The exhaust port 25 is connected with a suction motor which is mounted in the vertical body 11 through an air exhausting pipe 16.

Referring to FIG. 4, the air drawn through the suction opening flows into the separating space 22 in the cyclone unit 20 through the inlet 24. The drawn air flows in a tangential direction to the separating space 22 of a cylinder shape, and moves in a spiral pattern in the separating space 22. The drawn air uses the centrifugal force in the separating space 22, and dust is separated from the drawn air by the centrifugal force. The remaining dust is filtered while the drawn air flows into the grill member 23, after the dust is separated. The filtered air is discharged from the cyclone unit 20 through the exhaust port 25 which is disposed at the upper end of the cyclone unit 20.

The dust separating unit 30 is engaged to a lower end of the cyclone unit 20. The dust separating unit 30 collects the dust separated from the air by the cyclone unit 20, and compresses the collected dust. The dust separating unit 30 is detachably connected with the cyclone unit 20 so that the dust separating unit 30 is separated from the cyclone unit 20 as occasion demands. The cyclone unit 20 is fixed to the upper portion of the mounting space 14 in the vertical body 12. However, the dust separating unit 30 is connected to the cyclone unit 20 while dust is being separated, and disconnected from the body 10 when the separated dust is discharged to the exterior.

Referring to FIGS. 3 and 4, the dust separating unit 30 may comprise a dust separating casing 31 in which a dust separating space 36 of a cylinder shape is formed, an axis member 32 which is straightly disposed according to the center axis of the dust separating space 36, and a compressing plate 33 of a rectangular shape of which a surface is engaged with the axis member 32. The compressing plate 33 is rotatably mounted with the axis member 32.

Accordingly, the dust separating unit 30 may collect the dust which is separated from the drawn air by the cyclone unit 20 in the dust separating space 36 while connected with the cyclone unit 20 as shown in FIG. 4. The dust separating unit 30 may compress the dust collected in the dust separating space 36 using the compressing plate 33 which is mounted rotatably in the dust separating space 36. The dust separating unit 30 comprises a function of compressing dust such that the dust separating unit 30 is used for a long time and the cyclone unit 20 does not have to be detached from the cyclone unit 20 frequently.

The dust separating unit 30 comprises a fixing wall 34 (referring to FIG. 4) which occupies a space between the axis member 32 and the interior wall of the dust separating casing 31, and an upper cover 35 (referring to FIGS. 3 and 4) which covers an upper portion of the dust separating space 36.

The fixing wall 34 exerts compressing force on the dust collected in the opposite direction to the compressing plate 33 when the compressing plate 33 rotates, such that the dust is effectively compressed. The upper cover 35 covers the upper portion of the dust separating space 36 such that the upper cover 35 prevents the dust from re-scattering to the cyclone unit 20 while the dust is compressed in the dust separating unit 30. The upper cover 35 also presses the dust downward when the dust moves to the upper portion of the dust separating space 36. As a result, dust is effectively compressed and a great mount of dust is collected in the dust separating space 36.

The driving unit 40 is provided at a lower end of the dust separating unit 30. The driving unit 40 drives the compressing plate 33 in the dust separating unit 30, and also ascends and descends the dust separating unit 30 to detachably connect the dust separating unit 30 to the cyclone unit 20.

Referring to FIGS. 3 and 4, the driving unit 40 comprises a lever portion 50 which is disposed at a lower end of the dust separating casing 31 to be rotatably operated, and a rotating force transfer portion 60 which transfers a part of the rotating force of the lever portion 50 to the axis member 32.

The lever portion 50 comprises a lever body 51 of a circular shape, and a lever 52 which is protruded from a side of the lever body 51, and is rotatably operated. Two elevating grooves 51*a* which correspond to the two elevating protrusions 17*a* (referring to FIG. 2) which were described above are formed in a concave shape in a side of lever body 51. Accordingly, when the dust separating unit 30 is received on the separating unit receiving surface 17, the two elevating protrusions 17*a* and the two elevating grooves 51*a* are disposed to be opposed to each other.

If the lever body 51 is rotated by an operation of the lever 52, the two elevating protrusions 17*a* are inserted in the two elevating grooves 51*a* according to the circumferential direction of the lever body 51, and the lever body 51 is ascended and descended according to the movement of the two elevating protrusions 17*a* along the two elevating grooves 51*a*. As the lever body 51 is disposed at the lower end of the dust separating casing 31, the dust separating casing 31 is ascended and descended according to a height that the lever body 51 ascends and descends.

The rotating force transfer portion 60 transmits a part of the rotating force of the lever portion 50 to the axis member 32 when the lever portion 50 is rotated. The rotating force transfer portion 60 comprises a main gear 61 which is in contact with the upper surface of the lever body 51, and rotates integrally with the lever body 51, and a sub gear 62 which is rotated in mesh with the main gear 61. The sub gear 62 has a center engaged with a lower end of the axis member 32.

Referring to FIGS. 3 and 4, the main gear 61 is engaged on the upper surface of the lever body 51, if a user rotates the lever 52, the main gear 61 rotates along with the lever body 51. Additionally, if the main gear 61 rotates, the sub gear 62 engaged with the main gear 61 also rotates, such that the axis member 32 connected to the sub gear 62 and the compressing plate 33 rotate in the dust separating unit 30. Accordingly, the compressing plate 33 rotates by operation of the lever portion 50.

The main gear 61 has more teeth than the sub gear 62, so that the compressing plate 33 rotates about one cycle by the rotation of the lever 52 within a limited angle. For example, if a user rotates the lever 52 90 degrees, the compressing plate 33 may rotate about 360 degrees. Therefore, an operation to compress the dust is convenient. Because the main gear 61 has more teeth than the sub gear 62, the greater rotating force can be transmitted to the compressing plate 33 despite applying the same rotating force to the lever portion 50.

Hereinbelow, an operation of the vacuum cleaner 1 as described above will be explained with reference to FIGS. 5A to 7B.

Figure 5A:
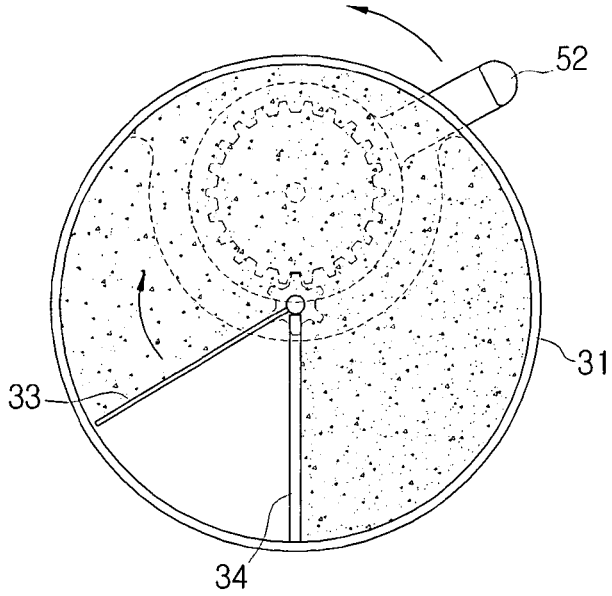
FIG. 5A is a sectional view along the line V-V of FIG. 4, before dust in a dust separating casing is compressed by a compressing plate.
Figure 5B:
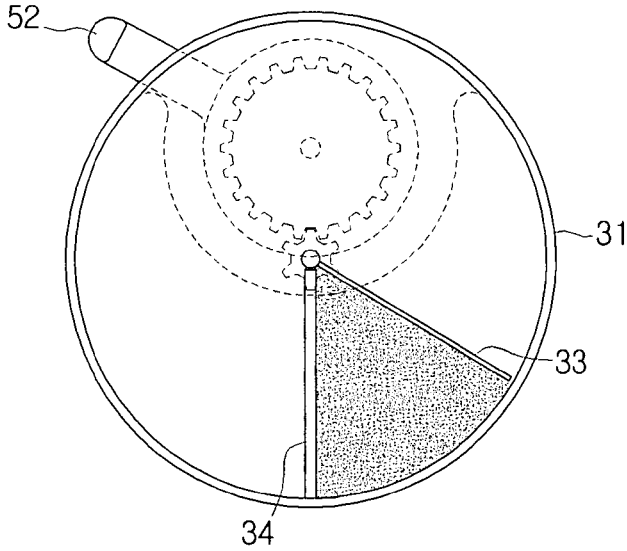
FIG. 5B is a sectional view along the line V-V of FIG. 4, after dust in a dust separating casing is compressed by a compressing plate.
Figure 6A:
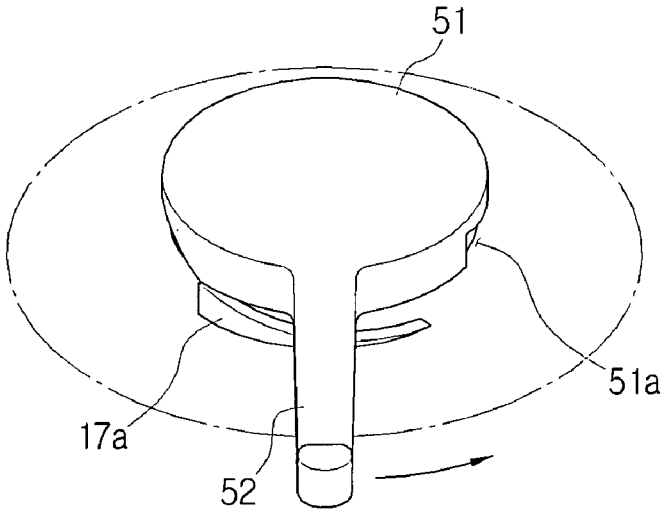
FIG. 6A is a perspective view illustrating an ascended lever body to describe ascending and descending of the lever body according to rotation of a lever.
Figure 6B:
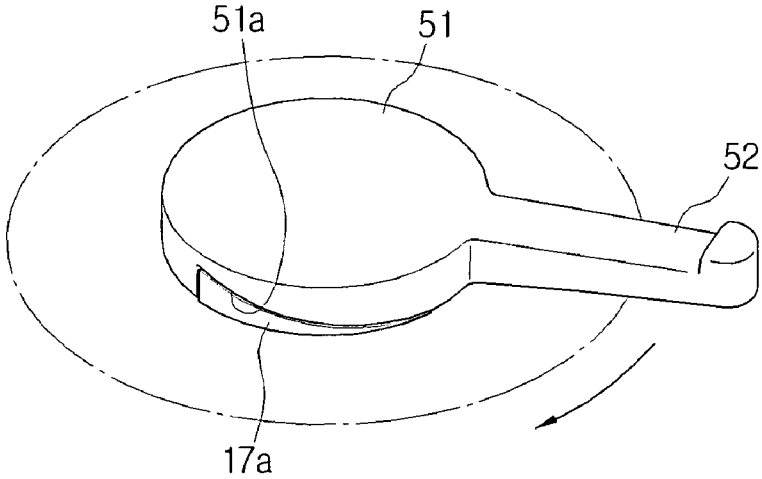
FIG. 6B is a perspective view illustrating a descended lever body to describe ascending and descending of the lever body according to rotation of a lever.
Figure 7A:
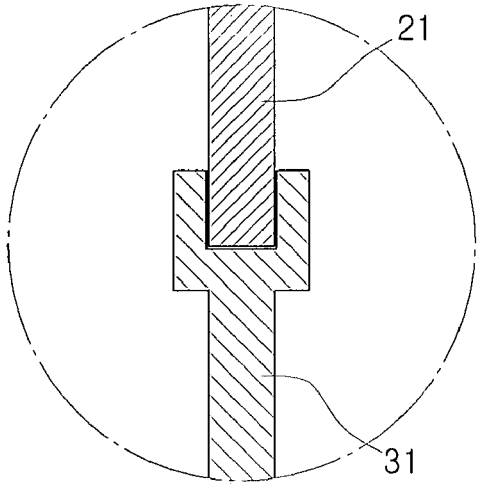
FIG. 7A is an enlarged perspective view illustrating a part B of FIG. 4 of a cyclone unit engaging a dust separating unit to describe detachment and attachment of the cyclone unit and the dust separating unit.
Figure 7B:
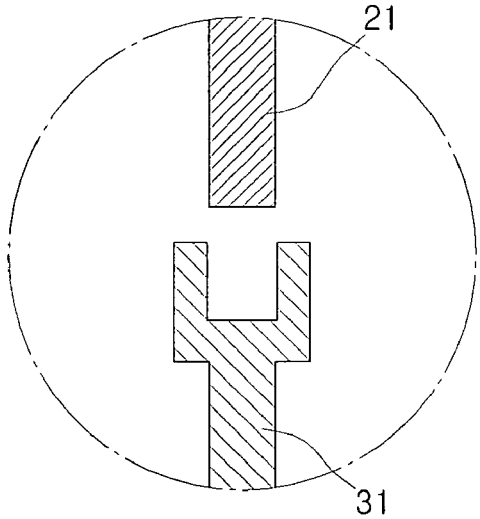
FIG. 7B is a view illustrating the cyclone unit detached from the dust separating unit to describe detachment and attachment of the cyclone unit and the dust separating unit.

FIG. 5A is a sectional view along the line V-V of FIG. 4, before dust in a separating casing is compressed by a compressing plate, FIG. 5B is a sectional view along the line V-V of FIG. 4, after dust in a separating casing is compressed by a compressing plate, FIG. 6A is a perspective view illustrating an ascended lever body to describe ascending and descending of the lever body according to rotation of a lever, FIG. 6B is a perspective view illustrating a descended lever body to describe ascending and descending of the lever body according to rotation of a lever, FIG. 7A is an enlarged perspective view illustrating a part B of FIG. 4 of a cyclone unit engaging a dust separating unit to describe detachment and attachment of the cyclone unit and the dust separating unit, and FIG. 7B is a view illustrating a cyclone unit detached from a dust separating unit to describe detachment and attachment of the cyclone unit and the dust separating unit.

If a user operates the vacuum cleaner to draw in dust on a surface to be cleaned, air containing dust is drawn in the interior of the horizontal body 11 through the suction opening formed on the bottom surface of the vertical body 11. The drawn air is introduced into the separating space 22 of the cyclone unit 20, passing the air flowing pipe 15 and the inlet 24 at the side of the cyclone unit 20. The drawn air descends in the separating space 22 while moving in a spiral pattern. The spiral movement of air generates the centrifugal force, and the dust is separated from the air by the centrifugal force. Eventually, the air loses the centrifugal force, and is discharged from the cyclone unit 20 by passing sequentially through the grill member 23 and the exhaust port 25 which is formed at the upper end of the cyclone unit 20. The discharged air is drawn in the suction motor in the horizontal body 11 through the air exhausting pipe 16 connected to the exhaust port 25, and discharged to the outside of the vacuum cleaner 1.

The dust separated from the drawn air by the cyclone unit 20 flows in the dust separating unit 30 engaged at the lower end of the cyclone unit 20. The upper cover 35 is disposed at the upper portion of the dust separating unit 30. However, because a dust slot 35*a* is formed at a part of the upper cover 35, the separated dust flows into the dust separating unit 30 without being blocked by an obstacle such as the upper cover 35.

If dust is piled up in the dust separating casing 31 as illustrated in FIG. 5A, a user operates the lever 52 to compress the dust in the dust separating casing 31. That is, if a user operates the lever 52 to rotate the lever body 51, the main gear 61 engaged to the lever body 51 rotates, and the sub gear 51 also rotates in association with the main gear 61. The axis member 32 and the compressing plate 33 also rotate according to the rotation of the sub gear 62. Referring to FIG. 5B, the dust in the dust separating casing 31 is compressed by the compressing force generated between the compressing plate 33 and the fixing wall 34. An operation of compressing dust by the operation of the lever 52 may be performed irrespective of engagement of the dust separating unit 30 and the cyclone unit 20, because the compressing plate 33 rotates according to the operation of the lever 52.

The dust separating casing 31 of the dust separating unit 30 and a cyclone unit casing 21 are engaged as illustrated in FIG. 7A, while the dust separating unit 30 is engaged to the cyclone unit 20. In this case, the two elevating protrusions 17*a* formed on the separating unit receiving surface 17 are not inserted in the two elevating grooves 51*a* of the lever body 51 as illustrated in FIG. 6A.

If a user rotates the lever 52 in a predetermined direction (in a counter clockwise direction in FIG. 6A), the two elevating protrusions 17*a* are inserted in the two elevating grooves 51*a* according to the rotation of the lever body 51. Accordingly, the lever body 51 is descended corresponding to the maximum height H of the two elevating protrusions 17*a*, and is kept in the position as illustrated in FIG. 6B. If the lever body 51 is descended simultaneously with the dust separating casing 31, the dust separating casing 31 at the upper portion of the lever body 51 is also descended such that the dust separating casing 31 and the cyclone unit casing 21 are detached as illustrated in FIG. 7B. At this time, a user may detach the dust separating unit 30 from the vacuum cleaner body 10, and discharge the dust in the dust separating casing 31 to the exterior.

If a user desires to engage the dust separating unit 30 back to the vacuum cleaner body 10, the user contacts the dust separating unit 30 on the separating unit receiving surface 17, and rotates the lever 52 in the opposite direction to a case of detaching the dust separating unit 30 from the cyclone unit 20. The lever body 51 and the dust separating casing 31 at the upper end of the lever body 51 are ascended such that the dust separating casing 31 and the cyclone unit casing 21 are engaged with each other.

A user can operate the lever 52 such that the dust collected in the dust separating unit 30 is compressed, and the dust separating unit 30 is detachably connected to the cyclone unit 20 by ascending and descending the dust separating unit 30. Therefore, the vacuum cleaner 1 has the structure for compressing dust and the structure for detachably connecting the dust separating unit 30, and yet provides simplified structure.

As described above, dust in a dust separating unit is compressed, and also the dust separating unit is detachably connected to a cyclone unit by rotating a lever. As a result, a vacuum cleaner of simplified construction and convenient operation is provided.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A vacuum cleaner comprising:

a vacuum cleaner body;

a cyclone unit which is mounted at the vacuum cleaner body, and separates dust from drawn air;

a dust separating unit which is engaged with a lower end of the cyclone unit, said dust separating unit being configured to collect separated dust, said dust separating unit being detachable from the cyclone unit, and said dust separating unit comprising a compressing plate compressing the collected dust; and a driving unit which is disposed at a lower end of the dust separating unit, said driving unit being configured to detachably couple the dust separating unit to the cyclone unit and to simultaneously drive the compressing plate.

2. The vacuum cleaner of claim 1, wherein the dust separating unit further comprises:

a dust separating casing which is detachably connected at a lower end of the cyclone unit, and comprises a dust separating space of a cylinder shape therein; and an axis member which is straightly disposed according to the center axis of the dust separating space, wherein the compressing plate is engaged with the axis member to rotate integrally with the axis member.

3. The vacuum cleaner of claim 2, wherein the driving unit comprises:

a lever portion which is disposed at a lower end of the dust separating casing to be rotatably operated, and configured to ascend and descend the dust separating unit according to the rotation of the driving unit, the dust separating unit being configured to be received on a separating unit receiving surface of the vacuum cleaner body; and a rotating force transfer portion which is configured to transfer a part of a rotating force of the lever portion to the axis member when the lever portion is rotated.

4. The vacuum cleaner of claim 3, wherein at least one elevating protrusion is formed on the separating unit receiving surface, the elevating protrusion having a slope surface, and wherein the lever portion comprises:

a lever body of a circular shape in which at least one elevating groove corresponding to a shape of the elevating protrusion is formed in a side of the lever body, and said lever body is connected with the rotating force transfer portion; and a lever which is protruded from the side of the lever body, and is rotatably operated, and wherein the elevating protrusion is configured to be inserted in the elevating groove if the lever body is rotated by an operation of the lever, wherein the lever body is configured to ascend and descend according to a circumferential direction of movement of the lever body, and wherein the rotating force transfer portion connected to the lever body is configured to be driven by operation of the lever.

5. The vacuum cleaner of claim 4, wherein the rotating force transfer portion comprises:

a main gear which is engaged with the upper surface of the lever body, and the main gear being configured to rotate integrally with the lever body; and a sub gear which is configured to rotate in mesh with the main gear, and which has a center engaged with a lower end of the axis member.

6. The vacuum cleaner of claim 5, wherein the main gear has more teeth than the sub gear to rotate the compressing plate to exceed an angle at which the lever is rotated.

7. The vacuum cleaner of claim 2, wherein the dust separating unit further comprises:

a fixing wall which is fixedly mounted to occupy a space between the axis member and an interior wall of the dust separating casing; and an upper cover which covers an upper portion of the dust separating space, and comprises a dust slot through which the dust separated by the dust separating unit flows into the dust separating casing.

8. A vacuum cleaner comprising:

a vacuum cleaner body;

a cyclone unit which is mounted at the vacuum cleaner body, and separates dust from drawn air;

a dust separating unit which is engaged with a lower end of the cyclone unit, said dust separating unit being configured to collect separated dust, said dust separating unit being detachable from the cyclone unit, and said dust separating unit comprising a compressing plate compressing the collected dust and a dust separating casing that is detachably connected at a lower end of the cyclone unit; and a driving unit which is disposed at a lower end of the dust separating unit, said driving unit being configured to ascend and descend the dust separating unit to be detachably connected to the cyclone unit and drive the compressing plate, wherein the dust separating unit further comprises an upper cover which covers an upper portion of the dust separating space, and comprises a dust slot through which the dust separated by the dust separating unit flows into the dust separating casing.

* * * * *